US007487885B2

(12) United States Patent
Keller et al.

(10) Patent No.: US 7,487,885 B2
(45) Date of Patent: Feb. 10, 2009

(54) DOSING DISPENSER FOR ESSENTIALLY SPHERICAL ITEMS CONTAINED IN A CONTAINER

(75) Inventors: Alexander Keller, Unterammergau (DE); Ingmar Kneer, Hohenpeissenberg (DE)

(73) Assignee: Gaplast GmbH, Altenau (DE)

( * ) Notice: Subject to any disclaimer, the term of this patent is extended or adjusted under 35 U.S.C. 154(b) by 0 days.

(21) Appl. No.: 10/549,473

(22) PCT Filed: Mar. 15, 2004

(86) PCT No.: PCT/DE2004/000518

§ 371 (c)(1),
(2), (4) Date: Jun. 28, 2006

(87) PCT Pub. No.: WO2004/083073

PCT Pub. Date: Sep. 30, 2004

(65) Prior Publication Data

US 2006/0255058 A1 Nov. 16, 2006

(30) Foreign Application Priority Data

Mar. 15, 2003 (DE) ..... 103 11 460

(51) Int. Cl.
*B65D 83/04* (2006.01)
*B65G 59/00* (2006.01)

(52) U.S. Cl. ..... 221/64; 221/260; 221/303; 221/307; 221/308

(58) Field of Classification Search ..... 221/1–312 C, 221/64, 260, 307–310
See application file for complete search history.

(56) References Cited

U.S. PATENT DOCUMENTS

| | | | | | |
|---|---|---|---|---|---|
| 3,042,257 | A * | 7/1962 | Dailey | 221/309 |
| 3,189,222 | A * | 6/1965 | Smalley | 221/220 |
| 3,412,897 | A * | 11/1968 | Slater | 221/226 |
| 3,481,513 | A * | 12/1969 | Ram | 222/490 |
| 4,648,529 | A * | 3/1987 | Blakemore et al. | 221/1 |
| 5,040,675 | A * | 8/1991 | Cleveland et al. | 206/315.9 |
| 6,029,850 | A * | 2/2000 | Pate et al. | 221/64 |
| 2004/0182879 | A1 * | 9/2004 | Kingsland et al. | 221/263 |

FOREIGN PATENT DOCUMENTS

| | | |
|---|---|---|
| DE | 11 07 407 | 5/1961 |
| DE | 298 07 492 U1 | 10/1999 |
| EP | 0 393 573 | 10/1990 |
| FR | 2 642 732 | 8/1990 |
| GB | 821070 | 9/1959 |

* cited by examiner

*Primary Examiner*—Gene Crawford
*Assistant Examiner*—Michael K Collins
(74) *Attorney, Agent, or Firm*—Pyle & Piontek, LLC

(57) ABSTRACT

The dosing dispenser for essentially spherical items contained in a container is characterized in that it comprises a passage channel whose inner cross-section is larger than the items, and an exit opening which in the relaxed state of the dosing dispenser has an elongated shape whose width is smaller and whose length is larger than the items. The dosing dispenser consists of a soft elastic plastic material and can be deformed by the application of pressure such that the exit opening gets larger than the items. The dosing dispenser is of a simple construction and can be produced at low costs.

12 Claims, 4 Drawing Sheets

DOSING DISPENSER FOR ESSENTIALLY SPHERICAL ITEMS CONTAINED IN A CONTAINER

BACKGROUND OF THE INVENTION

The present invention relates to a dosing dispenser for discharging approximately spherical items out of a container having an opening which the dosing dispenser is secured to. The items or drugs are preferably so-called globule containing a medical active ingredient without the invention being limited thereto.

Such items are normally not exactly spherical, and their size may vary within a large tolerance range. For instance, globuli may be present in a container filling in a size of about 1.8 mm to 2.5 mm or in another size of 3.4 mm to 4.0 mm. The outer surface of such globuli is in general not entirely smooth, so that globuli adjacent to one another may get "hooked or entangled".

OBJECTS OF THE INVENTION

It is the object of the present invention to provide a dosing dispenser of the type in question which while being of a simple construction can be produced at low costs.

Said object is achieved according to the invention by the features of patent claim 1.

Advantageous developments of the invention are characterized in the subclaims.

SUMMARY OF THE INVENTION

The dosing dispenser of the invention comprises a passage channel whose free inner cross-section is larger than the outer dimensions of the items to be discharged, and an exit opening which in the relaxed state of the dosing dispenser has an elongated shape whose width is smaller and whose length is larger than the outer dimensions of the items. The dosing dispenser consists of an elastomer-like plastic material and can be deformed by laterally applied pressure such that the exit opening is larger than the outer dimensions of the items.

Hence, the preferably oval exit opening which first retains the items in the overhead position of the container can be expanded in widthwise direction by laterally compressing the inventive dosing dispenser in such a manner that the items can fall out of the dosing dispenser.

With great advantage it is intended that in the passage path of the items, preferably on the inside on the passage channel, at least one retaining projection or retaining cam, preferably two opposite retaining cams, are formed, said cams in the relaxed state of the dosing dispenser being spaced apart from each other at a distance greater than the outer dimensions of the items. Therefore, in the relaxed state of the dosing dispenser the items can pass through the one or the two opposite retaining cams. However, when the dosing dispenser is compressed for widening the exit opening, the clearance between the retaining cams is reduced such that the passage of the items is blocked.

Furthermore, it is intended that an accommodating chamber in which only one single item can be accommodated remains between the exit opening of the dosing dispenser and the retaining cam(s).

In the overhead position of the container and thus of the dosing dispenser, the items thereby exit from the container and enter into the passage channel, the items being blocked by the elongated exit opening which has not been widened yet. One item is here positioned in the accommodating chamber between the exit opening and the retaining cams while the subsequent items are positioned in the passage channel before the retaining cams. The cams are here arranged at places that are opposite to each other in the longitudinal direction of the exit opening. When the dosing dispenser is now compressed laterally such that the exit opening is widened, the cams are simultaneously moved towards each other, thereby blocking the passage for the second and the further items.

This has the effect that upon each operation of the dosing dispenser only one single item is discharged at a time.

While in the formerly known dosing dispensers it is normally not guaranteed that the items are discharged only individually, this is ensured in the dosing dispenser of the invention when the accommodating chamber between the exit opening and the retaining cams is dimensioned such that only one item can be accommodated therein at a time.

It is within the scope of the invention that said accommodating chamber may also be dimensioned in case of need such that it can accommodate a specific and defined larger number of items, which will then also be discharged in a reliable manner upon operation of the dosing dispenser. However, an individual discharge is of utmost importance in practice.

It is suggested in further details that the dosing dispenser should comprise an annular plug section which is inserted into the container opening in tight contact therewith, as well as a circular annular lateral projection which rests on the upper edge of the container opening, and thereafter an operating section which projects beyond the container opening. Preferably, the operating section has a cylindrical shape that is approximately rectangular in plan view.

To facilitate a lateral compression of the operating section, it is suggested that two axially extending grooves should be formed on the outside in the circumferential wall of the operating section, in the case of a rectangular or oval shape centrally in the longitudinal sides, the two grooves being preferably positioned in a plane which bisects the elongated, preferably oval, exit opening in the direction of width. Said squeeze grooves preferably have a flat U-shaped form.

Furthermore, two grooves that are preferably V-shaped and adjoin the above-mentioned grooves and extend towards the exit opening are formed on the outside in the face wall of the operating section, said grooves being positioned along a line which thus also bisects the exit opening in widthwise direction. The operating section can be compressed easily at its narrow sides (when the basic shape is approximately rectangular) by means of said weakened wall sections.

Under a further essential aspect of the present invention the passage channel is formed by a tubular section which is attached at a distance from the exit opening on the inside to the operating section, the preferably two retaining cams being molded onto the end of the tubular section which is oriented towards the exit opening. The accommodating chamber for one item is positioned above said cams, said chamber thereby having a width slightly larger than the passage channel.

Under a further essential aspect of the present invention a free annular space remains between the inner wall of the operating section and the outer wall of the tubular section as long as the dosing dispenser is not compressed. The tubular section is preferably cut open in axial direction, so that it consists of at least two webs that are movable relative to each other, i.e., at least two narrow strips are cut away from the wall of the tubular section, resulting in slits extending up to the end of the tubular section. Said slits should face each other.

This has the effect that upon release of the dosing dispenser a shaking action is observed along the passage channel, whereby the adjacent items, which may be entangled with one another on their outer surfaces, are shaken free so that, depending on the position of the container, they may either fall back into the container or may slide for a subsequent dosing operation into the passage channel towards the exit opening.

Furthermore, it is intended that the dosing dispenser is made in one piece in an injection molding process. As a consequence, and in contrast to dosing dispensers of conventional types consisting of several parts, the dosing dispenser of the invention can be produced at low costs. Olefins are for example suited as a material for the dosing dispenser.

When the dosing dispenser is not used any more, it is expediently covered by a cap screwed onto the neck of the container. Said cap is preferably provided on the inside of its upper end wall with a central pin which in the secured state of the cap projects into the exit opening of the dosing dispenser. An item possibly clamped in the exit opening is thereby pushed back into the dosing dispenser.

Further details of the invention will become apparent from the following description of a preferred embodiment and from the drawings, in which:

Figure 1:
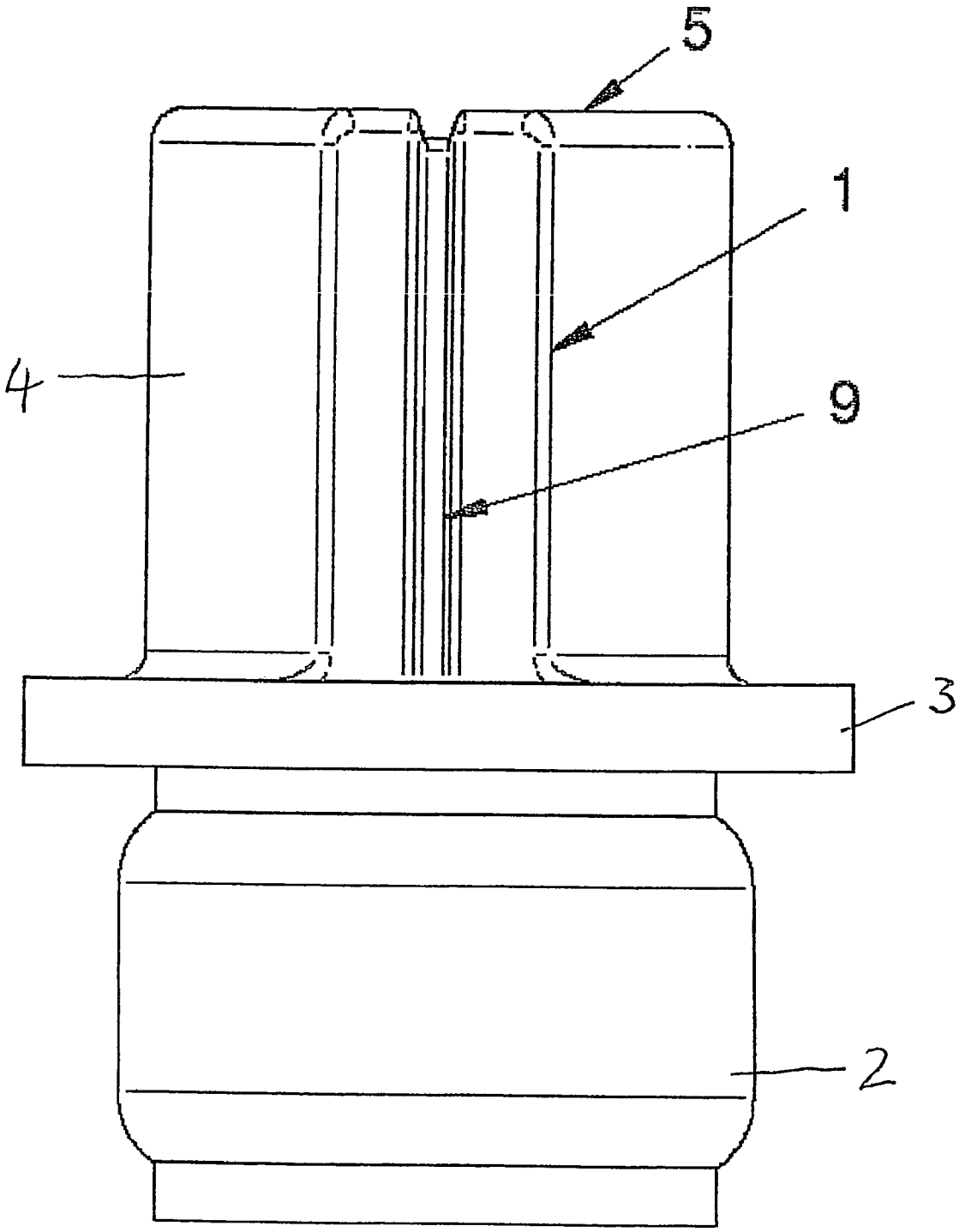
FIG. 1 is a side view of an embodiment of the dosing dispenser.

The dosing dispenser 1 comprises a lower annular plug section 2 (see FIG. 1), an adjoining circular lateral projection 3, and an upper operating section 4. The annular plug section 2 comprises an outwardly curved circumferential wall, a so-called sealing olive, which ensures that the plug section inserted into a container neck tightly rests on the inner wall of the container neck. The circular projection 3 is positioned on the upper edge of the container opening.

Figure 2:
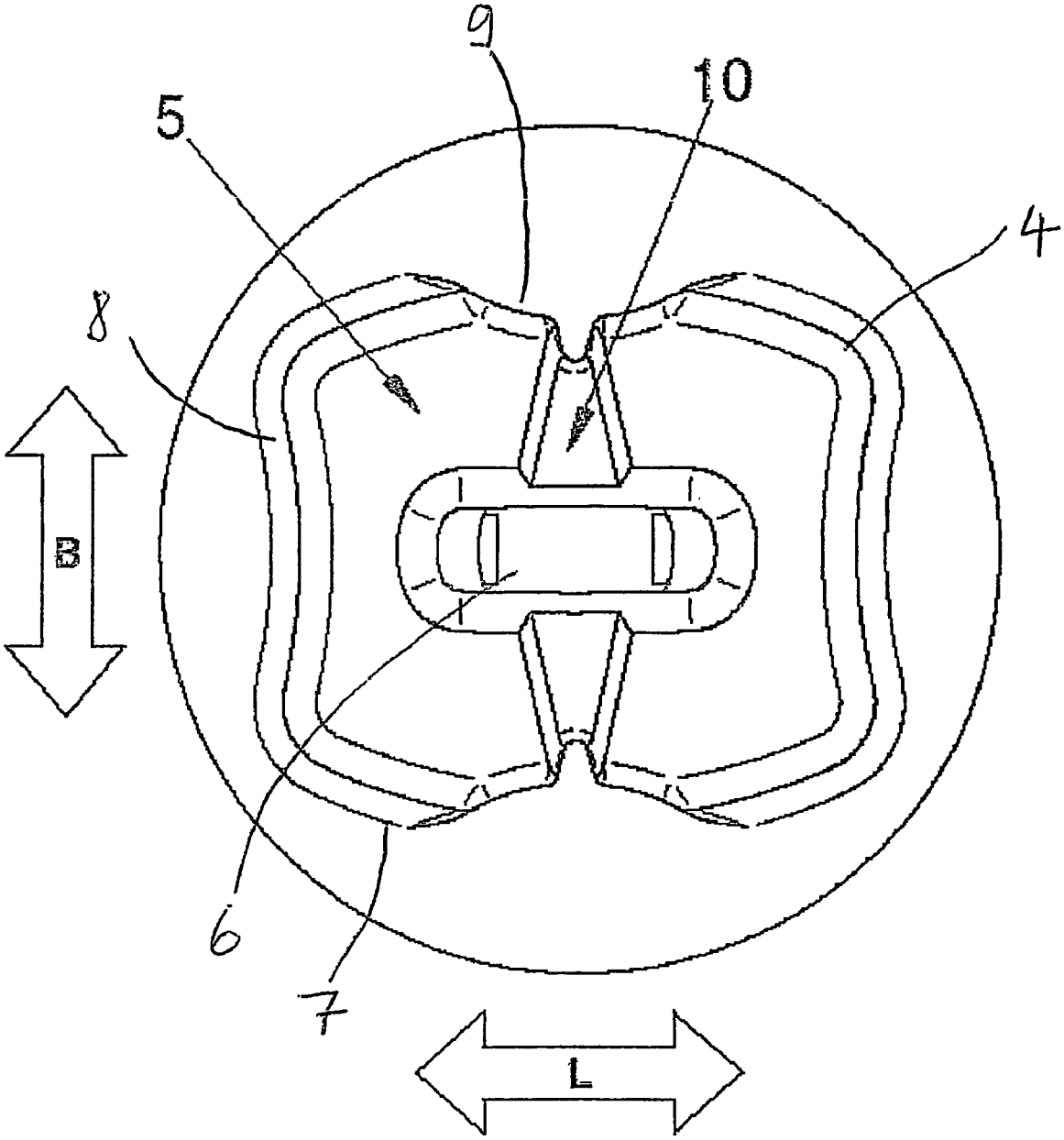
FIG. 2 is a top view on the dosing dispenser according to FIG. 1.
Figure 3:
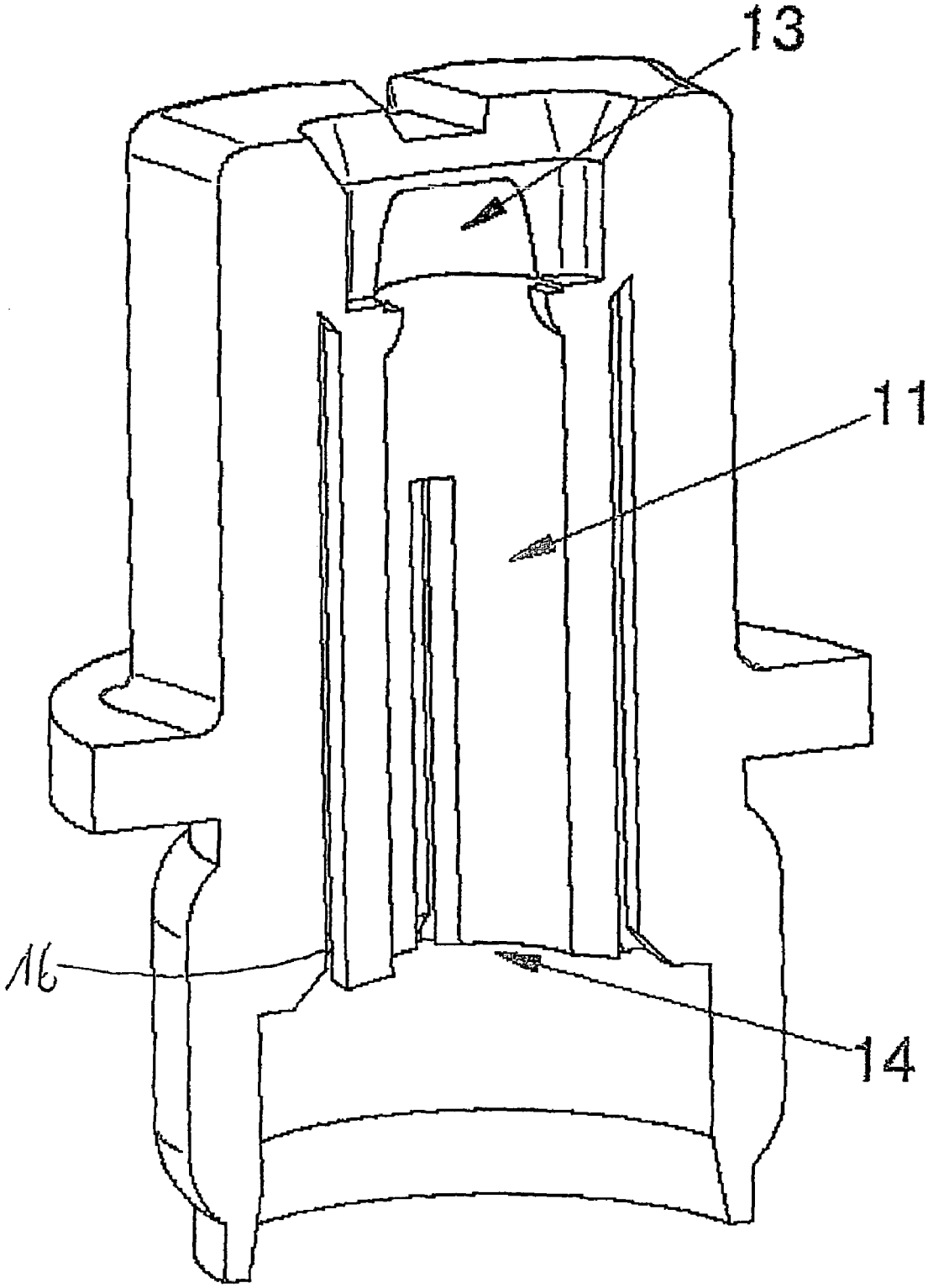
FIG. 3 is a perspective longitudinal section through the dosing dispenser.
Figure 4:
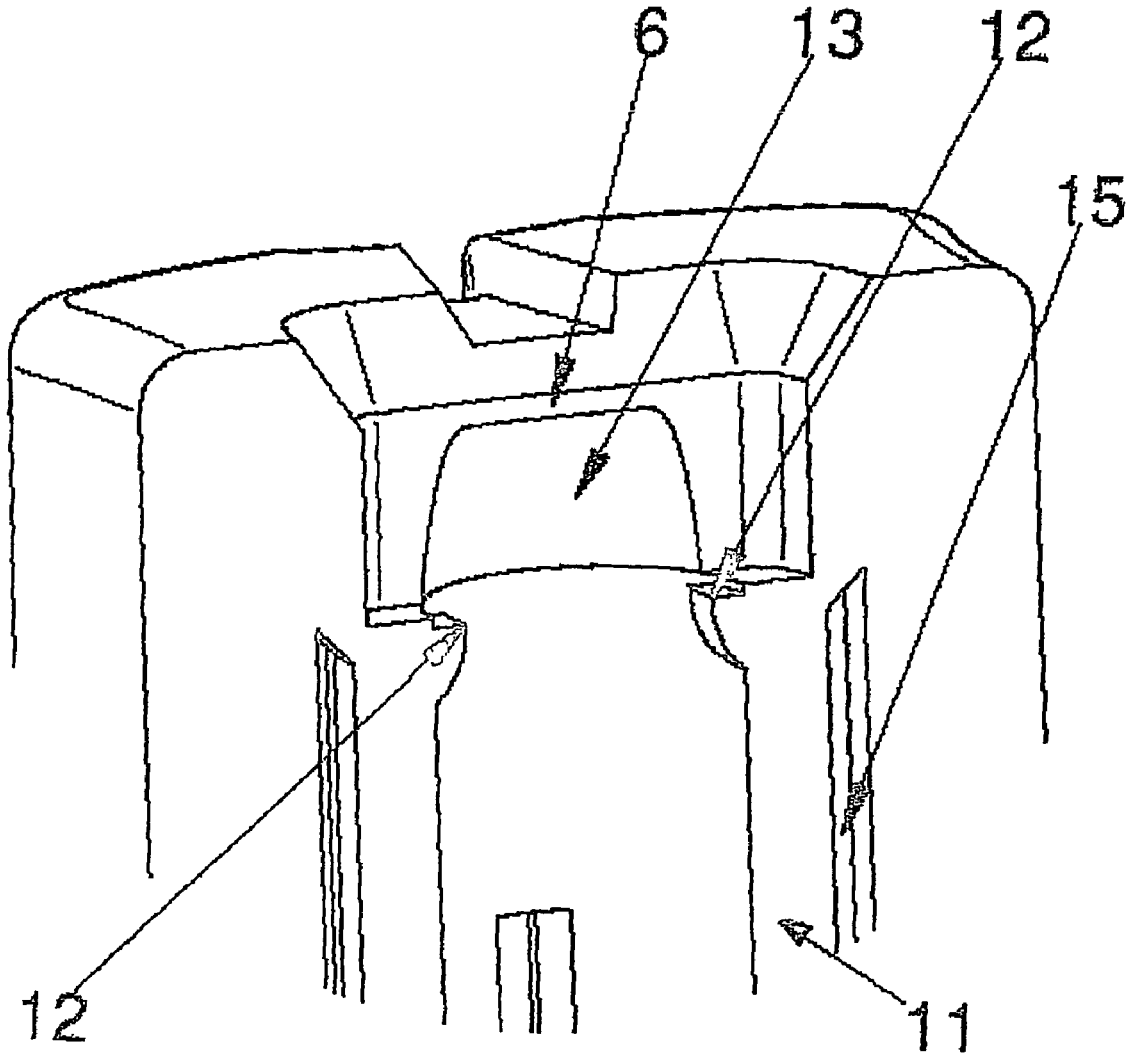
FIG. 4 is an enlarged view of the outlet region of the dosing dispenser in a vertical section.

The upper face wall 5 of the operating section 4 has formed therein an elongated exit opening 6 for items (not shown) of the container. The exit opening 6 has a width (in the direction of arrow B in FIG. 2) which is smaller than the items to be discharged with the dosing dispenser, and a length (direction of arrow L in FIG. 2) larger than the items.

When viewed from above, the operating section 4 has an approximately rectangular form whose long sides 7 are convexly curved forwards while the short sides 8 have a concave curvature. The convex longitudinal sides 7 are each provided in the center with a U-shaped squeeze notch 9 which extends up to the upper side and passes into a V-shaped squeeze notch 10 extending up to the exit opening 6 and provided in the face wall 5.

DETAILED DESCRIPTION

When the operating section 4 is compressed by exerting pressure on the concave sides 8 (arrows K in FIG. 2), the exit opening 6 will assume such a shape that one item can exit from the exit opening 6.

In the interior of the operating section 4, a tubular section 11 which extends in the axial direction of the dosing dispenser is centrally attached to the inner wall of the operating section 4. Near the upper end of the tubular section 11 two diametrically opposed projections or retaining cams 12 are formed on the inner wall of said section and have a clearance thereinbetween larger than the items, so that said items can pass through the retaining cams when the operating section 4 is not compressed.

A spacing remains between the upper side of the retaining cams 12 and the inside of the upper face wall 5 and is dimensioned such that the accommodating chamber 13 defined thereby can accommodate one item that is prevented by the elongated exit opening 6 from exiting out of the dosing dispenser 1 in the non-operated state.

The two retaining cams 12 are arranged in the longitudinal direction of the exit opening 6. Hence, when a compressive force is exerted on the sides 8 of the operating section 4 and deforms the exit opening 6 such that the Item positioned in the accommodating chamber 13 can exit, the clearance between the retaining cams 12 is simultaneously reduced with the release of the exit opening such that no subsequent item can pass through the two retaining cams 12. Therefore, the dosing dispenser 1 will always discharge only one single item when operated.

The annular section 11 whose lower entry opening 14 is exposed towards the interior of the container (not shown) is cut free from the inner wall 15 of the operating section 4. This means that in the relaxed state of the dosing dispenser a free annular space 16 remains between the outer circumferential wall of the annular section 11 and the inner wall 15 of the operating section 4.

Moreover, the tubular section 11 which forms the passage channel for the item is cut open in at least two circumferential sections that are movable relative to each other because the longitudinal slits extend up to the lower end of the tubular section 11. This has the consequence that upon discharge of one item and the subsequent release of the operating section 4 by the user it is not only the exit opening 6 that resumes its initial shape due to the rubber-elastic property of the dosing dispenser 1, and the tubular section 11 with the retaining cams 12 resumes its original shape, but a shaking action also takes place along the tubular section 11 because of its cut-open longitudinal webs, such an action releasing possibly entangled items, so that the items can either slide back into the container in the case of an upright arrangement of the container or, in an overhead position of the container (and the dosing dispenser), the next item can advance towards the exit opening 6.

As has already been mentioned above, the one-piece dosing dispenser is made from a rubber-like or elastomer-like material and is produced in an injection molding process.

What is claimed is:

1. A dosing dispenser for essentially spherical items contained in a container, the dosing dispenser (1) consisting of a soft elastic plastic material and comprising:

an operating section (4), a tubular section (11) having a passage channel whose inner cross-section is larger than the items, and an exit opening (6) which in a relaxed state of the soft elastic dosing dispenser (1) has an elongated shape whose width is smaller and whose length is larger than the items, the dosing dispenser being deformable by the application of pressure such that the exit opening gets larger than the items, and wherein the tubular section (11) having the passage channel is attached at a distance from the exit opening (6) to an inner wall of the operating section (4) of the dosing dispenser (1), two retaining cams (12) are on the end of the tubular section (11) and oriented towards the exit opening (6), and the tubular section (11) is cut open in an axial direction of the tubular section, so that the tubular section comprises at least two circumferential sections that are movable relative to each other.

2. The dosing dispenser according to claim 1, wherein the two retaining cams (12) on the end of the tubular section (11) are generally opposed to each other and have a clearance therebetween in the relaxed state of the dosing dispenser (1) that is larger than the items, and including an accommodating chamber (13) between the exit opening and the retaining cams (12) for receiving and accommodating one item.

3. The dosing dispenser according to claim 2, wherein the length of the exit opening (6) extends along a longitudinal direction and the retaining cams (12) are arranged at places located along the longitudinal direction of the exit opening (6).

4. The dosing dispenser according to claim 1, wherein the dosing dispenser (1) further comprises an annular plug section (2) for tightly resting on an inner wall of an opening to the container, and a circular lateral projection (3) for resting on an upper edge of the container opening, wherein the operating section (4) projects beyond the container opening.

5. The dosing dispenser according to claim 4, wherein two axially extending grooves (9) are formed on an outside of a circumferential wall of the operating section (4) in a plane bisecting the exit opening (6) in a width direction.

6. The dosing dispenser according to claim 4 including two grooves (10) formed on an outside of a face wall (5) of the operating section (4) along a line that bisects the exit opening (6) in width direction.

7. The dosing dispenser according to claim 1, wherein the tubular section (11) is attached at a distance from the exit opening (6) to an inner wall (15) of the operating section (4), and the two retaining cams (12) are formed on the end of the tubular section (11) towards the exit opening (6).

8. The dosing dispenser according to claim 7, wherein a free annular space (16) is between the inner wall (15) of the operating section (4) and an outer wall of the tubular section (11).

9. The dosing dispenser according to claim 7, wherein the tubular section (11) includes at least one slot extending in the axial direction so that it comprises at least two circumferential sections that are movable relative to each other.

10. The dosing dispenser according to claim 1, wherein the dosing dispenser (1) is made in one piece in an injection molding process.

11. The dosing dispenser according to claim 1 in combination with the container.

12. The dosing dispenser and container according to claim 11, including a cap having an inwardly projecting pin which projects into the exit opening (6) of the dosing dispenser (1) in a state where the cap is mounted on a neck of the container.

* * * * *